US008070229B2

(12) United States Patent
Woodring

(10) Patent No.: US 8,070,229 B2
(45) Date of Patent: Dec. 6, 2011

(54) MONOBLOC ROCKING CHAIR

(76) Inventor: Cooper C. Woodring, Wakefield, RI (US)

( * ) Notice: Subject to any disclaimer, the term of this patent is extended or adjusted under 35 U.S.C. 154(b) by 0 days.

(21) Appl. No.: 12/233,177

(22) Filed: Sep. 18, 2008

(65) Prior Publication Data

US 2010/0066139 A1 Mar. 18, 2010

(51) Int. Cl.
*A47C 3/02* (2006.01)

(52) U.S. Cl. ..... 297/271.6; 297/271.5; 297/239

(58) Field of Classification Search ..... 297/239, 297/271.5, 271.6
See application file for complete search history.

(56) References Cited

U.S. PATENT DOCUMENTS 1,297,718 A * 3/1919 Mueller ..... 297/271.6
1,660,119 A * 2/1928 Decker ..... 446/69
2,419,838 A * 4/1947 James ..... 297/239
2,558,466 A * 6/1951 Simard et al. ..... 297/131
2,670,787 A * 3/1954 Vandas et al. ..... 297/411.41
2,703,135 A * 3/1955 Leatherman ..... 297/239
2,845,699 A 8/1958 Woodard
2,936,826 A 5/1960 Reineman
3,556,586 A * 1/1971 Beardmore ..... 297/3
3,604,749 A * 9/1971 Parmett et al. ..... 297/239
3,637,256 A * 1/1972 Harty ..... 297/248
3,909,064 A * 9/1975 Payne et al. ..... 297/440.23
3,944,280 A * 3/1976 Keeler ..... 297/239
4,210,182 A 7/1980 Danko
4,328,991 A * 5/1982 Mengshoel et al. ..... 297/271.1
4,341,419 A * 7/1982 Sebel ..... 297/239
4,609,225 A * 9/1986 Loucks ..... 297/16.1
D287,669 S * 1/1987 Opsvik ..... D6/330
D302,216 S 7/1989 Roland
5,044,691 A 9/1991 Guichon
5,094,507 A * 3/1992 Gibbs ..... 297/239
D329,757 S 9/1992 Meeker
D334,671 S * 4/1993 Mayer ..... D6/348
D338,114 S * 8/1993 Morin ..... D6/370
D350,650 S 9/1994 Chaney et al.
D360,315 S 7/1995 Morin
D361,902 S 9/1995 VanSkiver
D362,759 S 10/1995 Sagol
D373,255 S 9/1996 Gresens
D373,473 S 9/1996 Grosfillex
D380,633 S 7/1997 Shaw
5,678,890 A * 10/1997 Tenbroeck ..... 297/271.6
5,702,152 A * 12/1997 Shaw ..... 297/133
D396,357 S * 7/1998 Perrin et al. ..... D6/349
5,833,307 A 11/1998 Leach et al.
5,839,781 A 11/1998 Knape (Continued)

OTHER PUBLICATIONS

The Illustrated History of Rocking Chairs, Birgit Lohman/ Designboom, 2005.

(Continued)

*Primary Examiner* — Laurie Cranmer
(74) *Attorney, Agent, or Firm* — SAIDMAN DesignLaw Group

(57) ABSTRACT

The present disclosure is directed to a monobloc rocking chair. The rocking chair includes a seat, backrest, a pair of front legs, a pair of rear legs, and rockers extending between front and rear legs. The chair is molded of a single material include a downwardly opening cavity and formed to taper outwardly from top to bottom. The cavity is formed by the seat being supported directly from below by front legs and being supported directly from above by a backrest. Rear legs are spaced from the seat. This allows two identical chairs to nest when vertically stacked for compact shipping, storage, or display. The monobloc rocking chair can include one or more arms or be armless.

6 Claims, 15 Drawing Sheets

U.S. PATENT DOCUMENTS

| | | | | |
|---|---|---|---|---|
| D412,406 | S | 8/1999 | Stumpf et al. | |
| D420,522 | S | 2/2000 | Rhienen | |
| 6,290,294 | B1 * | 9/2001 | Volz | 297/270.5 |
| 6,292,990 | B1 | 9/2001 | Iseki et al. | |
| 6,416,123 | B1 | 7/2002 | Bell | |
| 6,511,127 | B2 * | 1/2003 | Wilkens | 297/270.5 |
| 6,676,206 | B2 * | 1/2004 | Brandschain | 297/32 |
| 7,011,368 | B2 * | 3/2006 | Barth et al. | 297/239 |
| D521,752 | S | 5/2006 | Messier | |
| D526,495 | S | 8/2006 | Albin | |
| D548,986 | S | 8/2007 | McCoy et al. | |
| 7,252,333 | B2 * | 8/2007 | Caldwell | 297/259.2 |

OTHER PUBLICATIONS

Fiell, Charlotte & Peter, 1,000 Chairs, 2000, p. 444, Benedikt Taschen Verlag, Germany.

Fiell, Charlotte & Peter, 1,000 Chairs, 2000, p. 430, Benedikt Taschen Verlag, Germany.

Fiell, Charlotte & Peter, 1,000 Chairs, 2000, p. 432, Benedikt Taschen Verlag, Germany.

Fiell, Charlotte & Peter, 1,000 Chairs, 2000, p. 425, Benedikt Taschen Verlag, Germany.

www.DESIGNBOOM.com, The monobloc plastic chair, Selene Chair, 1969, Vico Magistretti.

www.DESIGNBOOM.com, The monobloc plastic chair, The Panton Chair, 1973, Werner Panton.

www.DESIGNBOOM.com, The monobloc plastic chair, rocking chair, 2004, Rebecca Ahlstedt.

www.DESIGNBOOM.com, The monobloc plastic chair, plastic rocker, 2002, Mike Simonian and Maaike Evers.

www.DESIGNBOOM.com, The monobloc plastic chair, reanim project, a medicine for objects, 2003, 5.5 Designers.

www.DESIGNBOOM.com, The monobloc plastic chair, Statement Chair 2004, Marti Guixe.

www.STYLEPARK.COM, Driade, Toy Easy Chair, at least as early as Sep. 16, 2007, Philippe Starck.

* cited by examiner

10''''
10'''
10''
10'
10
72

MONOBLOC ROCKING CHAIR

BACKGROUND OF THE DISCLOSURE

1. Field of the Disclosure

The present disclosure provides a monobloc rocking chair. More particularly, the present disclosure provides a one-piece, integrally molded plastic rocking chair that nests or fits within an identical rocking chair when such chairs are vertically stacked.

2. Description of Related Art

Plastic chairs are well-known. An exemplary prior art plastic chair is shown in U.S. Pat. No. Des. 373,255. This prior art chair includes a seat, a back, front and rear legs directly connected to the seat, and arms joining the seat to the back. These chairs include an opening bounded by the arms, back and seat. Plastic chairs with this configuration can be stacked vertically, so that the rear legs of the uppermost chair extend through the opening bounded by the arms, back and seat. The chairs are configured so that they vertically stack compactly. Consequently, the chairs can be shipped, stored, and displayed more economically. This is advantageous for manufacturers, retailers, and consumers. Plastic chairs are also advantageous because they are comfortable, inexpensive to manufacture, practical, lightweight, portable, water and weatherproof, sturdy, attractive, relatively easy to care for, and easy to move to and from a stacked arrangement. However, these chairs are stationary.

Many people enjoy rocking chairs. In an effort to get more enjoyment out of stationary plastic chairs, some have developed separate rocker kits that convert a conventional plastic chair into a rocking chair. U.S. Pat. No. 5,833,307 shows an example of this approach. This requires that separate rockers be attached to a chair which is disadvantageous because complex mechanisms are necessary to assure the chair remains connected to the rocker. This increases manufacturing costs. In addition, the chairs with the rockers cannot be stored compactly.

An exemplary plastic rocking chair with integral rockers was designed by Mike Simonian and Maaike Evers. This plastic rocker includes a seat, a backrest, arms, front legs directly connected to the seat, and rear legs directly connected to the seat. Rockers extend from the right front leg to the right rear leg and from the left front leg to the left rear leg. The rockers prevent this chair from being stacked compactly. As a result, it cannot be shipped, stored, and displayed economically. This is a disadvantage for manufacturers, retailers, and consumers.

Therefore a need exists for a one-piece rocking chair that is inexpensive to manufacture, comfortable, lightweight, attractive, portable, water and weatherproof, durable, and easy to care for, compactly stackable, and easy to move to and from a stacked arrangement.

SUMMARY OF THE DISCLOSURE

In one example, a rocking chair comprises a top, a bottom, a seat, a backrest, first and second front legs, first and second rear legs, and first and second curved rockers. The backrest directly connects to the seat and supports the seat from above the seat. The first and second front legs support the seat from beneath the seat. The first and second rear legs are spaced from the seat and connect to the backrest. The first and second front legs and the first and second rear legs each include a substantially planar outer side surface. The first curved rocker joins the first front leg and the first rear leg. The second curved rocker joins the second front leg and the second rear leg. The first and second curved rockers each include a substantially planar inner surface. The seat, backrest, first and second front legs, first and second rear legs, and first and second curved rockers are molded as a single monolithic piece. In addition, the seat, backrest, first and second front legs, first and second rear legs, and first and second curved rockers define a downwardly opening cavity that enlarges from top to bottom. The rocking chair nests with a substantially identical second rocking chair such that a portion of the substantially planar inner surface of the first and second curved rockers of the rocking chair slides over a portion of the substantially planar outer side surface of the front and rear legs of the second rocking chair.

Furthermore, the rocking chair may include a rear wall that extends between the first rear leg and the second rear leg. Each of the first and second curved rockers may include a structural rigidity feature.

In the exemplary rocking chair, each of the first and second curved rockers may include a forward radius of curvature and a rearward radius of curvature, where the rearward radius of curvature is greater than the forward radius of curvature.

Alternatively, the rocking chair may include a pair of spaced apart arms connected to the backrest, seat, first and second front legs, and first and second rear legs. Moreover, the downwardly opening cavity may include a first hollow portion adjacent the backrest, second and third hollow portions adjacent the arms, and a fourth hollow portion below the seat.

Another exemplary rocking chair further includes a front wall, a rear wall spaced from the front wall, first and second sidewalls that join the front and rear walls, and an intermediate wall. Portions of the front wall and forward portions of the first and second sidewalls form the first and second front legs. Portions of the rear wall and rearward portions of the first and second sidewalls form the first and second rear legs. The intermediate wall extends between the front and rear walls and defines the backrest and the seat. The front wall, first and second sidewalls, and rear wall diverge outwardly from a vertical plane at a draft angle between about 7 and 10 degrees. Furthermore, the draft angle is about 8 degrees.

In such rocking chair, the front wall, rear wall, first and second sidewalls, and intermediate wall define the downwardly opening cavity. In addition, the backrest may be angularly offset from the vertical plane. In such chair, the backrest may be angularly offset from the vertical plane by about 15 degrees.

In addition, the chair may include a pair of spaced apart arms connected to the backrest, the seat, the first and second front legs, and the first and second rear legs.

Such exemplary rocking chair further includes being molded as a single monolithic piece of plastic. The rocking chair further includes the downwardly opening cavity has a volume equal to more than 50% of the rocking chair volume. Alternatively the downwardly opening cavity has a volume equal to more than 90% of the rocking chair volume. The first and second curved rockers each include a height and a thickness. The rocker height is larger than the rocker thickness. The first and second curved rockers include curved lower edges configured to prevent said rocking chair from tipping over backward during use. The distance between the first and second curved rockers comprises a rocker width. The rocker width is significantly greater than the width of said seat. The exemplary rocking chair further includes a front wall, a rear wall, a first sidewall and a second sidewall. The first sidewall includes the first curved rocker, and the second sidewall includes the second curved rocker. The first sidewall joins the front and rear walls at spaced apart first sidewall edges. The second sidewall joins the front and rear walls at spaced apart second sidewall edges. Each of the first and second curved rockers includes a lower edge having a radius of curvature such that one contact portion of the lower edge contacts the ground and the remainder of each of the lower edges is out of contact with the ground. During rocking, the contact portion of each of the first and second rockers changes along the lower edge. The rocking chair includes a generally square footprint.

In yet another example, a set of rocking chairs is disclosed, the set comprises a first rocking chair and a substantially identical second rocking chair. Each of the first and second rocking chairs have a top, a bottom, a seat, a backrest directly connected to the seat and supporting the seat from above the seat, first and second front legs supporting the seat from beneath the seat and spaced forwardly and laterally outwardly therefrom, first and second rear legs spaced rearwardly and laterally outwardly from the seat and connected to the backrest, and first and second curved rockers. Each of the first and second front legs has an outer surface and an inner surface. Each of the first and second rear legs has an outer surface and an inner surface. The first curved rocker joins the first front leg and the first rear leg and the second curved rocker joins the second front leg and the second rear leg. Each of the first and second curved rockers extends rearwardly of the seat and has an outer surface and an inner surface. The first rocking chair and second rocking chair are molded of a single material, and are configured and dimensioned to include a downwardly opening cavity. The downwardly opening cavity outwardly diverging from the top to the bottom. When the first rocking chair is lowered onto the second rocking chair, the second rocking chair fits within the downwardly opening cavity of the first rocking chair by having a portion of the inner surfaces of the front legs, the rear legs and the rockers of the first rocking chair slide over portions of the outer surfaces of the front legs, the rear legs and the rockers of the second rocking chair.

In such set, a distance between an upper surface of the first rocking chair and an upper surface of the second rocking chair may be less than about 2 inches. Alternatively, the distance is about 1.5 inches.

In such set, a majority of the second rocking chair fits within the downwardly opening cavity of the first rocking chair.

BRIEF DESCRIPTION OF THE DRAWINGS

FIG. 10A is a partial, enlarged cross-sectional view of a portion of the chairs within circle 10A-10A of FIG. 10;

DETAILED DESCRIPTION

Figures 1, 2:
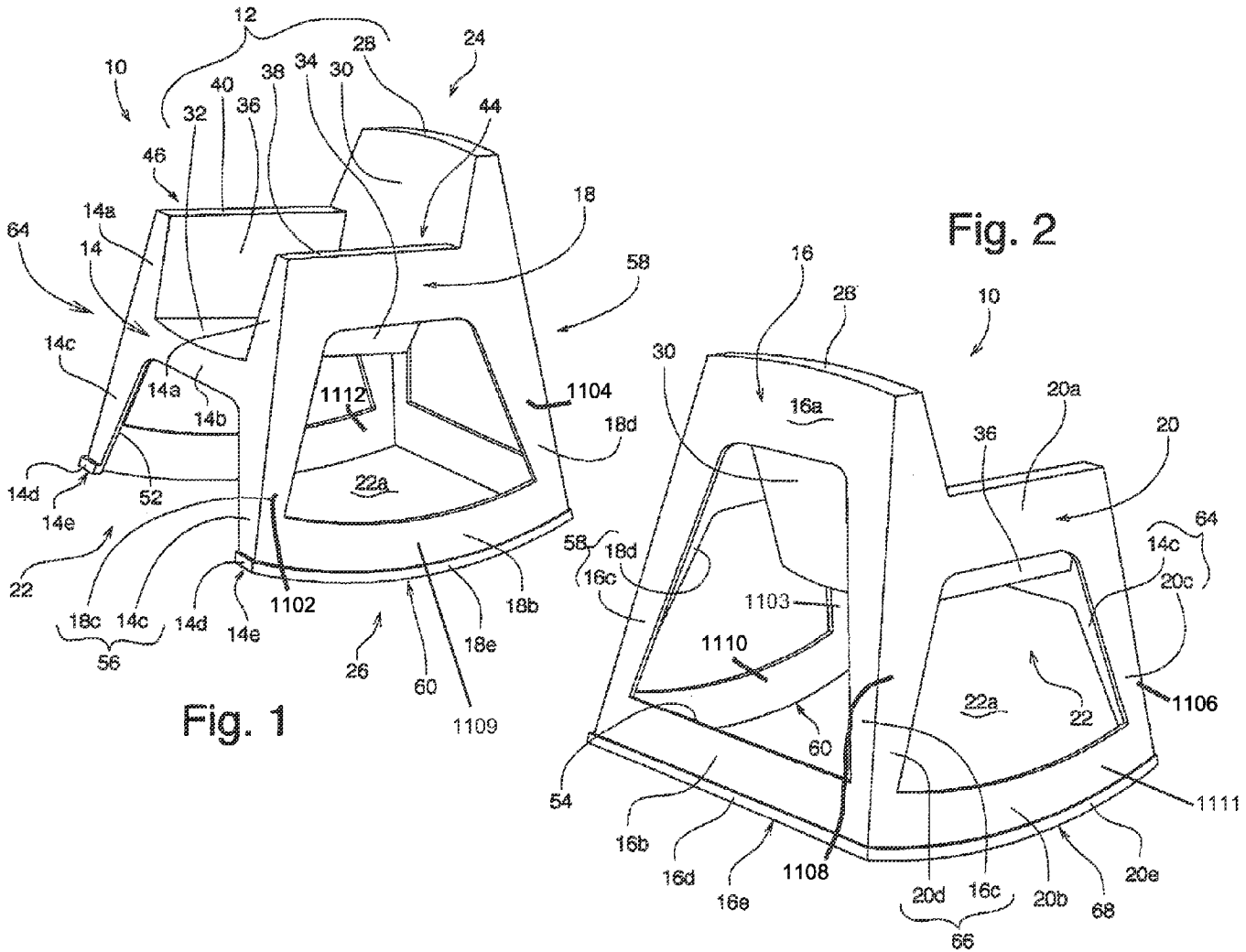
FIG. 1 is a front, left-side, perspective view of a first example of a rocking chair.
FIG. 2 is a rear, right-side, perspective view of the rocking chair of FIG. 1.

Referring to FIGS. 1-2, a first example of a rocking chair 10 is shown. Chair 10 includes intermediate wall 12, front wall 14, rear wall 16, and spaced first and second sidewalls 18 and 20. Intermediate wall 12, front wall 14, rear wall 16, and first and second sidewalls 18 define a downwardly open cavity 22 so that chair 10 is hollow from the underside or open to full view from therebelow. The cross-sectional area of chair 10 increases from top 24 to bottom 26.

Figures 9, 10:
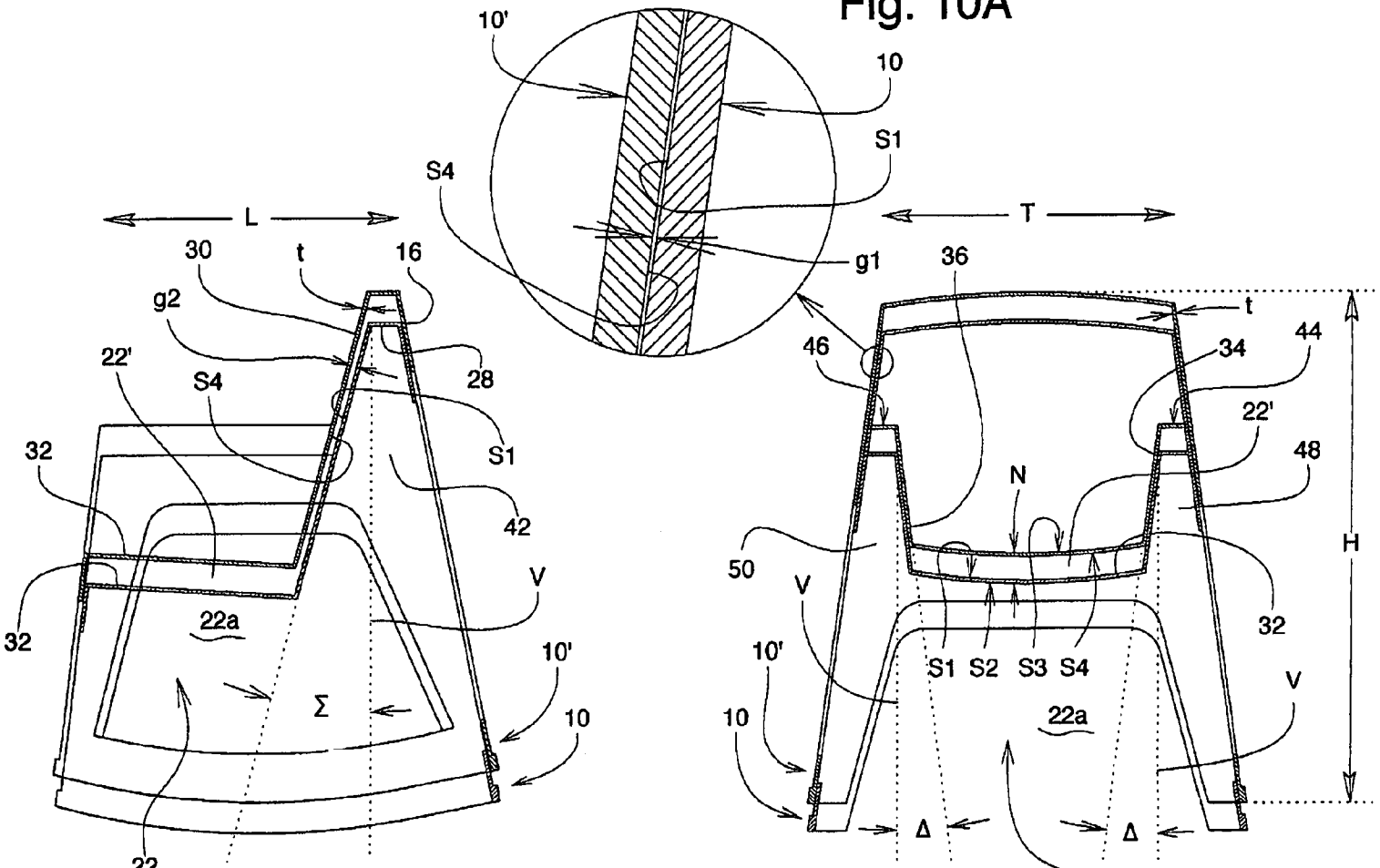
FIG. 9 is a longitudinal, partial cross-sectional view of two chairs of FIG. 1 stacked and nested.
FIG. 10 is a transverse, partial cross-sectional view of the chairs of FIG. 9.

Referring again to FIG. 1, intermediate wall 12 includes top wall portion 28, backrest 30, seat 32, first and second generally vertical armrest portions 34 and 36, and first and second generally horizontal armrest portions 38 and 40. Top wall portion 28 of intermediate wall 12 is generally curved as shown in FIGS. 1-4. As best seen in FIGS. 5-8, top wall portion 28 joins rear wall 16 with backrest 30. As best seen in FIG. 9, backrest 30 is spaced from rear wall 16 to form first or backrest hollow portion 42 of open cavity 22.

Referring to FIG. 9, backrest 30 is angularly offset from vertical plane V by an angle $\Sigma$ of about 15 degrees. The present invention is not limited to angle $\Sigma$. Angle $\Sigma$ is selected based on ergonomic or comfort requirements not nesting requirements so that a user has comfortable back support.

Referring to FIGS. 1 and 10, seat 32 is a generally horizontal surface. Seat 32 preferably has curvature along transverse axis T (as shown in FIG. 10) and is generally straight along longitudinal axis L (as shown in FIG. 9). Curvature along transverse axis T makes seat 32 more comfortable. Optionally, seat 32 may also be curved along longitudinal axis L, such seat would be said to have a compound curvature (i.e., curvature along two axes), which is more comfortable and makes such seat more rigid. A second seat hollow portion 22*a* is disposed beneath seat 32 and defined by seat 32 and walls 14, 16, 18 and 20.

Figure 7:
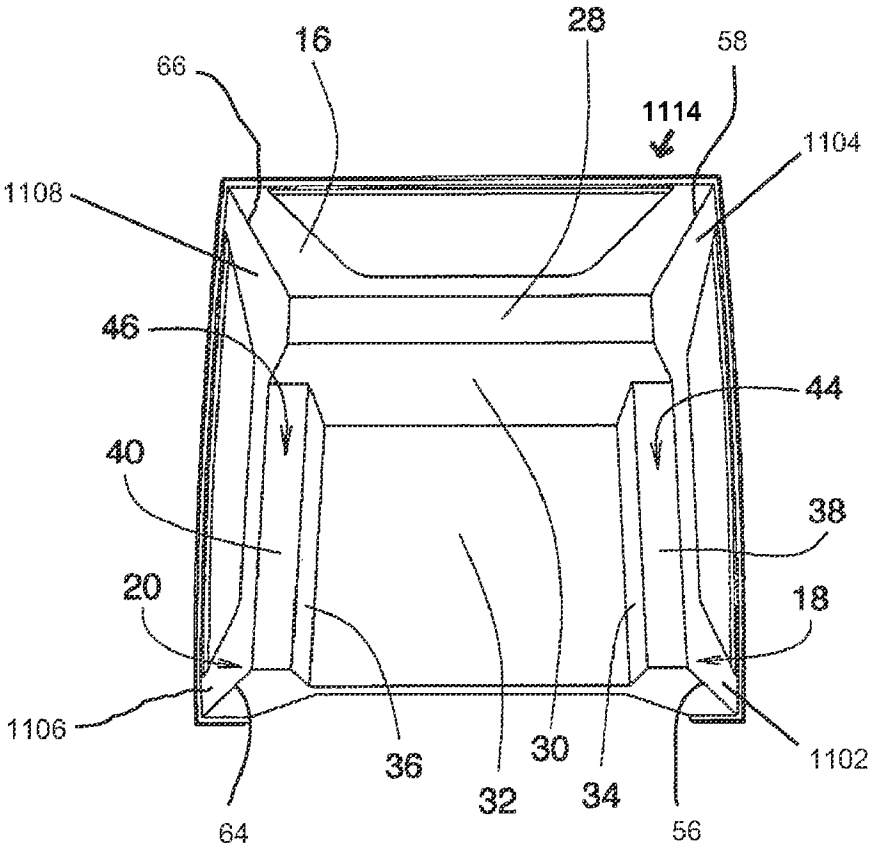

Referring to FIG. 7, first and second generally vertical armrest portions 34 and 36 are spaced apart and directly connected to seat 32. As shown in FIG. 10, armrest portions 34, 36 are angularly offset from vertical plane V by draft angle $\Delta$ to be discussed below.

Referring to FIG. 7, first generally horizontal armrest portion 38 joins first sidewall 18 to first vertical armrest portion 34 and second generally horizontal armrest portion 40 joins second sidewall 20 to second vertical armrest portion 36. As a result, intermediate wall 12 and upper portions of first and second sidewalls 18 and 20 define spaced apart first and second arms 44 and 46. Moreover, referring to FIGS. 10 and 7, cavity 22 includes third and fourth armrest hollow portions 48, 50 within arms 44 and 46, respectively, between intermediate wall 12 and first and second sidewalls 18, 20, respectively. As shown in FIG. 7, chair 10 includes a generally rectangular footprint 1114.

Figure 5:
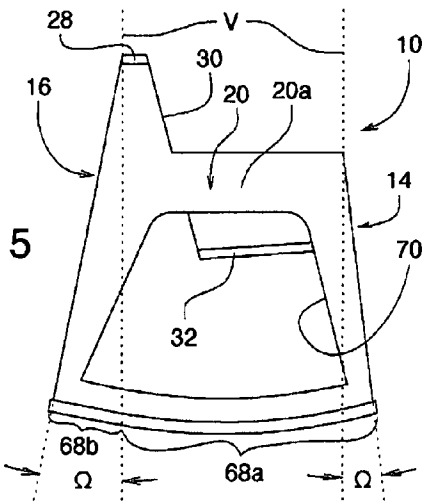

Referring to FIGS. 1 and 5, front wall 14 is generally H-shaped. Front wall 14 is angularly offset from vertical plane V by draft angle Ω to be discussed in detail below.

Front wall 14 includes upper portions 14*a* disposed above seat 32, lower central and side portions 14*b* and 14*c* disposed below seat 32. Upper portions 14*a* cap off arms 44, 46. Lower central portion 14*b* adds structural rigidity to chair 10. Front wall 14 further defines cutout 52, which is optional. Cutout 52 allows a user's legs to rest beneath seat 32. Cutout 52 can be removed, which would add material and thus cost to chair 10.

Additionally, front wall 14 includes enlarged portions 14*d* with a greater thickness than front wall portions 14*a*-14*c*. Enlarged portions 14*d* add structural rigidity to chair 10 at lower edges 14*e*, which contact the ground.

Referring to FIGS. 2 and 5, rear wall 16 is generally shaped like a truncated triangle. Rear wall 16 is angularly offset from vertical plane V by draft angle Ω to be discussed in detail below.

Figure 4:
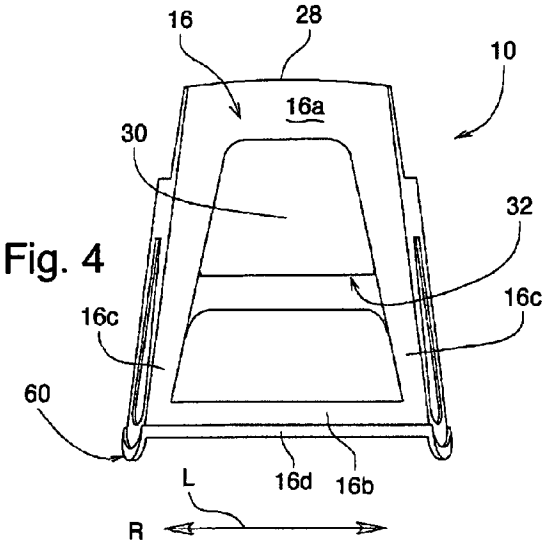
FIGS. 3 and 4 are front and rear views, respectively, of the rocking chair of FIG. 1.
Figure 8:
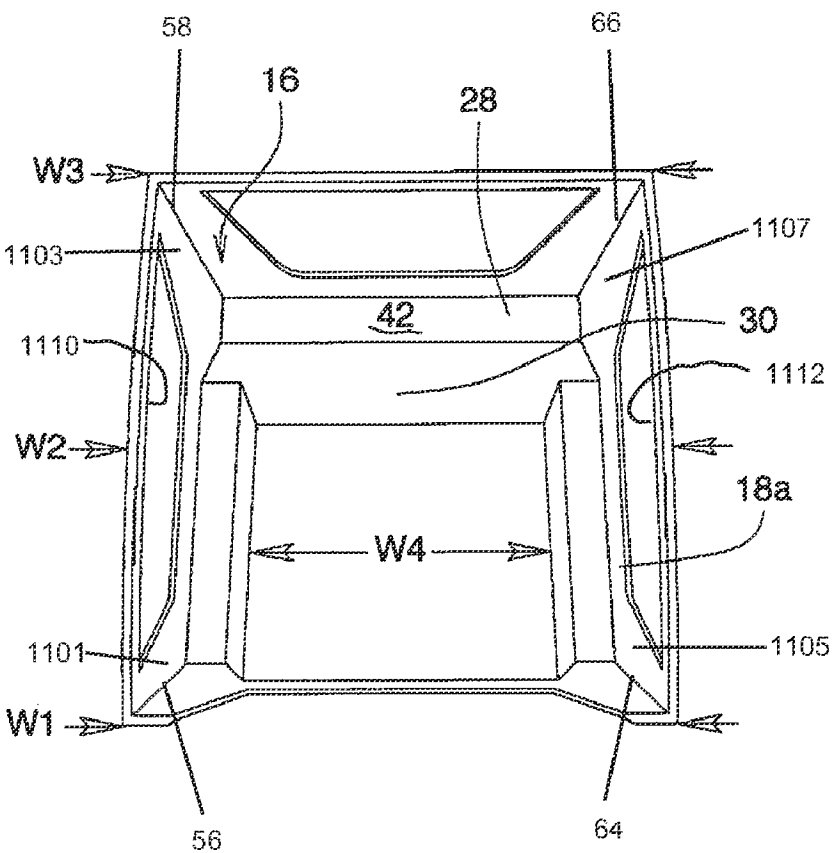
FIGS. 7 and 8 are top and bottom views of the rocking chair of FIG. 1.

Referring to FIGS. 2 and 4, rear wall 16 includes upper portion 16*a* disposed above seat 32, lower central and side portions 16*b* and 16*c* disposed below seat 32. Upper portion 16*a* aids in forming first backrest hollow portion 42 (as seen in FIGS. 8 and 9). Lower central portion 16*b* adds structural rigidity to chair 10. Rear wall 16 further defines opening 54, which is optional. Opening 54 allows less material to be used thus decreasing the cost of chair 10.

Referring to FIGS. 1 and 2, if more rigidity is necessary for front wall 14, front wall 14 may include a lower central portion (not shown) between side portions 14*c* like lower central portion 16*b*. Thus, transforming cutout 52 into an opening like opening 54.

Referring again to FIG. 2, rear wall 16 further includes enlarged portion 16*d* with a greater thickness than rear wall portions 16*a*-16*c*. Enlarged portion 16*d* adds structural rigidity to chair at lower edge 16*e*, which contacts the ground.

Figure 6:
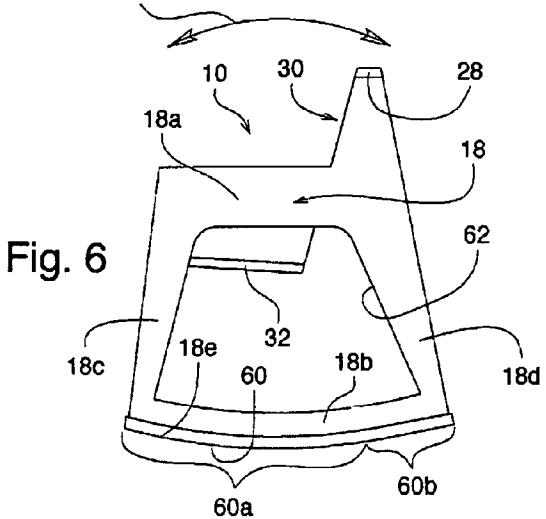
FIGS. 5 and 6 are right-side and left-side views, respectively, along arrows 5 and 6 of the rocking chair of FIG. 3.

Referring to FIG. 6, first sidewall 18 includes upper portion 18*a* disposed above seat 32. First sidewall 18 further includes lower central portion 18*b*, lower forward portion 18*c*, and lower rearward portion 18*d* disposed below seat 32. Referring to FIGS. 8 and 10, upper portion 18*a* helps form first backrest hollow portion 42 and third armrest hollow portion 48. Referring again to FIG. 6, lower central portion 18*b*, which is the upper part of rocker 60, adds structural rigidity to chair 10. Lower central portion 18*b* of rocker 60 may have a substantially planar outer surface 1109, and may include a substantially planar inner surface 1110, as shown in FIGS. 1 and 2.

Referring to FIG. 1, lower side portion 14*c* of front wall 14 joins with lower forward portion 18*c* of first sidewall 18 to form first front leg 56. Referring to FIG. 2, lower side portion 16*c* of rear wall 16 joins with rearward portion 18*d* of first sidewall 18 to form first rear leg 58. First front leg 56 and first rear leg 58 may each include a substantially planar outer side surface 1102, 1104 and a substantially planar inner side surface 1101, 1103 (see also FIGS. 7 and 8).

Referring to FIGS. 1 and 6, additionally, first sidewall 18 includes enlarged portion 18*e* with a greater thickness than sidewall portions 18*a*-18*d*. Enlarged portion 18*e* adds structural rigidity to chair 10 at curved lower edge 60, which contacts the ground and acts as a rocker.

Referring to FIG. 6, first sidewall 18 further defines opening 62, which is optional. Opening 62 allows less material to be used thus decreasing the weight and cost of chair 10.

Referring to FIGS. 2 and 5, second sidewall 20 includes upper portion 20*a* disposed above seat 32. Second sidewall 20 further includes lower central portion 20*b*, lower forward portion 20*c*, and lower rearward portion god disposed below seat 32. Referring to FIGS. 8 and 10, upper portion 20*a* helps to form first backrest hollow portion 42 and fourth armrest hollow portion 50. Referring again to FIG. 2, lower central portion 20*b*, which is the upper part of rocker 68, adds structural rigidity to chair 10. Lower central portion 20*b* of rocker 68 may have a substantially planar outer surface 1111 and, as shown in FIG. 1, may include a substantially planar inner surface 1112.

Referring to FIG. 2, lower side portion 14*c* of front wall 14 (See FIG. 1) joins with lower forward portion 20*c* of second sidewall 20 and forms second front leg 64. Lower side portion 16*c* of rear wall 16 joins with rearward portion 20*d* of second sidewall 20 to form second rear leg 66. Second front leg 64 and second rear leg 66 may each include a substantially planar outer side surface 1106, 1108, and a substantially planar inner side surface 1105, 1107 (see also FIGS. 7 and 8).

Additionally, second sidewall 20 includes enlarged portion 20*e* with a greater thickness than sidewall portions 20*a*-20*d*. Enlarged portion 20*e* adds structural rigidity to chair 10 adjacent curved lower edge 68, which contacts the ground and acts as a rocker for chair 10. Referring to FIGS. 1 and 2, enlarged portions 14*d*, 16*d*, 18*e* and 20*e* are optional and structural rigidity may be added to rockers in another way, as discussed below with respect to FIGS. 16 and 17.

Referring to FIG. 5, second sidewall 20 further defines opening 70, which is optional. Opening 70 allows less material to be used thus decreasing the weight and cost of chair 10.

Referring to FIGS. 2 and 6, curved lower edges 60 and 68 are configured to allow chair 10 to rock as indicated by arrow R, when a user pushes off of the ground or shifts their weight along longitudinal axis L. As a result, "rocker" or curved lower edge 60 extends from first front leg 56 to first rear leg 58 and "rocker" or curved lower edge 68 extends from second front leg 64 to second rear leg 66.

Curved lower edges 60 and 68 are also configured to prevent chair 10 from tipping over backward during use. In the present example, referring to FIGS. 5-6, curved lower edges 60 and 68 have first segments 60*a*, 68*a* and rearward second segments 60*b*, 68*b*, respectively. First segments 60*a*, 68*a* have a first forward radius of curvature designed to allow rocking. In the present example, the forward radius of curvature is about 50". The present invention is not limited to this forward radius of curvature. Second segments 60*b*, 68*b* have a second rearward radius of curvature different from first radius of curvature. Preferably, the rearward radius of curvature is greater than the forward radius of curvature so that second segments 60*b*, 68*b* are flatter than first segments 60*a*, 68*a* to slow rocking of chair 10 and prevent chair 10 from tipping over backward. In the present example, the rearward radius of curvature is about 70". The present invention is not limited to this rearward radius of curvature.

Figure 3:
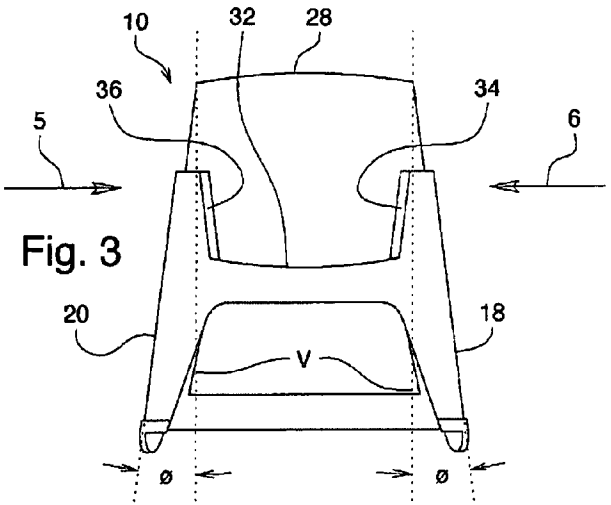

As shown in FIG. 3, first and second sidewalls 18, 20 are angularly offset from vertical plane V by draft angle ϕ to be discussed in detail below.

Referring to FIG. 8, the lower portion of chair 10 has first width W1 at the front, second width W2 at the center, and third width W3 at the rear. First, second, and third widths W1, W2, and W3 are different. Third width W3 is smaller than first and second widths W1 and W2 and second width W2 is smaller than first width W1. As a result, chair 10 narrows from first width W1 to second width W2 and narrows from second width W2 to third width W3. In the present chair 10, there is an optional curvature between widths W1, W2 and W3. The narrowing of chair 10 from front to rear is optional.

Referring to FIGS. 1-2, intermediate wall 12, front wall 14, rear wall 16, and first and second sidewalls 18, 20 are molded of a single material. As a result, chair 10 has a monolithic, one-piece, integral or monobloc construction.

An exemplary material is plastic. Plastic can include no recycled material or can include a percentage of recycled material. Chair 10 may be injection molded of plastic so that all of the features discussed above are formed during the molding cycle. An exemplary plastic for use in forming chair 10 is polypropylene. Chair 10 is formed without undercuts or only small undercuts, thus a cam or other device is not necessary to remove chair 10 from a mold.

Alternatively, chair 10 can be formed of materials such as polycarbonate. One exemplary polycarbonate material that can be used is LEXAN®. Since polycarbonate is stronger than polypropylene, a polycarbonate chair can have thinner walls than a polypropylene chair and thus lighter weight. If wall thickness t (See FIG. 10) is reduced, structural elements (not shown) can be added to underside of seat 32 (See FIG. 1) to reinforce seat 32, as known by those of ordinary skill in the art. These structural elements can be designed so as not to affect nesting of chair 10. Alternatively, these structural elements can be designed to provide a purposeful stop for nesting, as discussed below.

Exemplary plastic material for chair 10 has an ultraviolet (UV) inhibitor therein as chair 10 is most frequently used outdoors and would deteriorate very quickly in sunlight without UV inhibitors. However, such inhibitors are optional. Exemplary plastic material may also include additional chemicals, as known by those of ordinary skill in the art, for example to tint or stiffen the plastic.

Chair 10 of polypropylene is preferably designed to have seat width W4 (shown in FIG. 8) of about 17 inches and the strength to support about 250 lbs. If a chair with a greater weight limit is desired, seat width W4 would probably be increased, thickness t (See FIG. 10) would probably be increased and/or a stronger material (such as polycarbonate) would need to be used. Referring to FIGS. 9-10 and 1-2, wall thickness t is the thickness of intermediate wall 12, front wall 14, rear wall 16, and sidewalls 18, 20 except at enlarged portions 14*d*, 16*d*, 18*e* and 20*e*. Although wall thickness t (in FIGS. 9-10) is shown as constant, some minor variation of wall thickness t is contemplated.

As known by those of ordinary skill in the art, computer software is used to analyze three dimensional shapes (such as chairs) to determine wall thickness t (See FIGS. 9-10) both in quantitative terms and based on location in order to obtain a given strength requirement of a given material. When this analysis is completed, the mold for such products is machined to be "steel safe." The mold is finalized by forming a series of chairs for testing. The first chair formed with the "steel safe" mold has the thinnest possible walls. If these chairs are too weak, some steel is removed from the mold (resulting in thicker walls) and the chair is made again. This process is repeated until chair 10 with the proper strength is formed. In this way, material is removed from the mold, but never added, resulting in chairs that are not over engineered for strength. Thus, the lightest weight and cheapest cost per chair is achieved. Consequently, wall thickness t (in FIGS. 9-10) is a guideline that will vary somewhat throughout chair 10, when chair 10 is produced.

Referring to FIGS. 9-10, two identical chairs 10 and 10' are shown. Chairs 10 and 10' are vertically stacked. Chairs 10 and 10' are configured and dimensioned to "nest" when vertically stacked. "Nest" or "nesting" is defined in the present specification and claims to mean that lowermost chair 10 fits within uppermost chair 10'. More specifically, when uppermost chair 10' is lowered onto lowermost chair 10, lowermost chair 10 fits within downwardly opening cavity 22' of uppermost chair 10'. In order to nest, chairs 10, 10' include downwardly opening cavities 22, 22' with first, second, third and fourth h fourth hollow portions 42, 22*a*, 48, and 50 (See FIGS. 9 and 10). Referring to FIGS. 1-2 and 9-10, as a result, lower backrest 32 fits within first hollow portion 42. Lower portion of front walls 14*c*, rear wall 16*c*, and sidewalls 18*c*-18*d*, 20*c*-20*d* and seat 32 fit within second hollow portion 22*a*. Arm 44 fits within third hollow 48 and arm 46 fits within fourth hollow portion 50. As chair 10 nests within chair 10', a portion of the substantially planar inner surfaces 1110, 1112 of the first and second curved rockers 60, 68 of the chair 10' slides over a portion of the substantially planar outer side surface 1102, 1104, 1106, 1108 of the front and rear legs 56, 58, 64, 66 of the chair 10.

Referring to FIGS. 1-2, downwardly opening cavity 22 is achieved by directly connecting front legs 56, 64 to seat 32, directly connecting backrest 30 to seat 32 and spacing rear legs 58, 66 from seat 32. As a result, rear legs 58, 66 are not directly connected to seat 32 and seat 32 is suspended from sides and rear via intermediate wall 12 and sidewalls 18, 20. Downwardly opening cavity 22 is not obstructed by generally horizontal surfaces that interfere with nesting. For example, rockers 60, 68, front wall 14, rear wall 16, and sidewalls 18, 20 are generally vertical so as to not interfere with nesting. Further, as also seen in FIGS. 7 and 8, front legs 58, 64 generally extend downwardly and outwardly from seat 32 while rear legs 58, 66 generally extend downwardly and outwardly from backrest 30.

Referring to FIG. 1, in addition, in order to nest, chair 10 includes walls that diverge outwardly from top 24 to bottom 26. Referring to FIGS. 10, 5, and 3, if each of draft angles $\Delta$, $\Omega$, $\Sigma$ and $\phi$ were equal to zero armrest portions 34, 36, front wall 14, rear wall 16, and sidewalls 18, 20 would be vertical and chair 10 and 10' (See FIG. 9) would not nest. So draft angles $\Delta$, $\Sigma$, $\Omega$ and $\phi$ must be large enough to allow nesting. Draft angles $\Delta$, $\Sigma$, $\Omega$ and $\phi$ must be small enough to be close to vertical to prevent front wall 14, rear wall 16 and sidewalls 18, from deforming outwardly during use. Thus, vertical enough to provide the necessary structural integrity to chair 10.

In addition, first and second generally vertical armrest portions 34 and 36 (See FIG. 3), are as close to vertical as possible so that seat width W4 is sufficiently wide to accommodate a person weighing 250 lbs. and chair overall widths W1-W3 are sufficient for a chair with such seat width W4.

Referring to FIG. 10, for chair 10 of height H of approximately 31 inches and wall thickness t of about 7/32nds of an inch, draft angles $\Delta$, $\Sigma$, $\Omega$, and $\phi$ are between about 7 degrees to about 11 degrees. More preferably, draft angles $\Delta$, $\Sigma$, and $\phi$ are about 7 degrees, and draft angle $\Omega$ is about 11 degrees. The present invention is not limited to these draft angles $\Delta$, $\Sigma$, $\Omega$, and $\phi$.

In the present example, chairs 10 and 10' are designed with height H, wall thickness t and draft angles $\Delta$, $\Sigma$, $\Omega$, and $\phi$ so that identical chairs 10 nest by fitting a majority or more than 50% of a rocking chair volume within uppermost chair 10'. More specifically, more than 90% of a rocking chair volume is fit within uppermost chair 10'. The rocking chair volume of chairs 10 and 10' are identical.

Referring again to FIG. 10, lower chair 10 has upper surface S1 and lower surface S2. Upper chair 10' has upper surface S3 and lower surface S4. Nesting allows the height of a stack of chairs 10, 10' to be chair height H plus nesting increment N. Nesting increment N is the distance between upper surface S1 of lower chair 10 and upper surface S3 of upper chair 10'. If chairs 10, 10' did not nest, the stack height would be significantly greater and would equal the sum of the chair heights. In the present example, the nesting increment N is about 1.5 inches. The present invention in not limited hereto. If a chair has a 31 inch height H, and a nesting increment N of 2 inches, then 93.5% of lower chair 10 is nested within upper chair 10'.

Referring to FIGS. 9 and 10A, when chairs 10, 10' are stacked, there are gaps g1 and g2 (see FIGS. 9 and 10A) there between of about 1/32nd of an inch (or 0.03125 inches). Gaps g1 and g2 are space for air between portions of upper surface S1 and portions of lower surface S4 to prevent a vacuum from being created between chairs 10, 10'. If a vacuum were created, chairs 10, 10' would be very difficult to separate. A vacuum is more easily created when chairs 10, 10' are wet or dirty.

Nesting stops, in the present example, when there is an interference fit between portions of chairs 10, 10' due to angular offset or draft angles Δ, Σ, Ω and ϕ of walls 12, 14, 16, 18, 20. In an alternative design, nesting can be stopped with a purposeful stop designed into chairs 10, 10', as previously discussed.

Referring to FIGS. 1 and 2, when stacked all generally horizontal surfaces, such as top wall portion 28, armrest portions 38 and 40, seat 32, and enlarged portions 14*e*, 16*e*, 18*e*, 20*e* are spaced apart so as not to interfere with nesting and nesting increment N.

Referring to FIGS. 9 and 10, when chairs 10, 10' are stacked, the stack is generally vertical with no offset in the transverse or longitudinal axes T and L between chairs, which allows the stack to be fairly stable and less likely to tip over.

Referring to FIGS. 1, 2, and 10, lower surface S4 of upper chair 10' must generally match upper surface S1 of lower chair 10 for nesting except for at enlarged portions 14*d*, 16*d*, 18*e*, and 20*e*. This allows open cavity 22' of chair 10' to receive chair 10 therein.

Figures 11, 12:
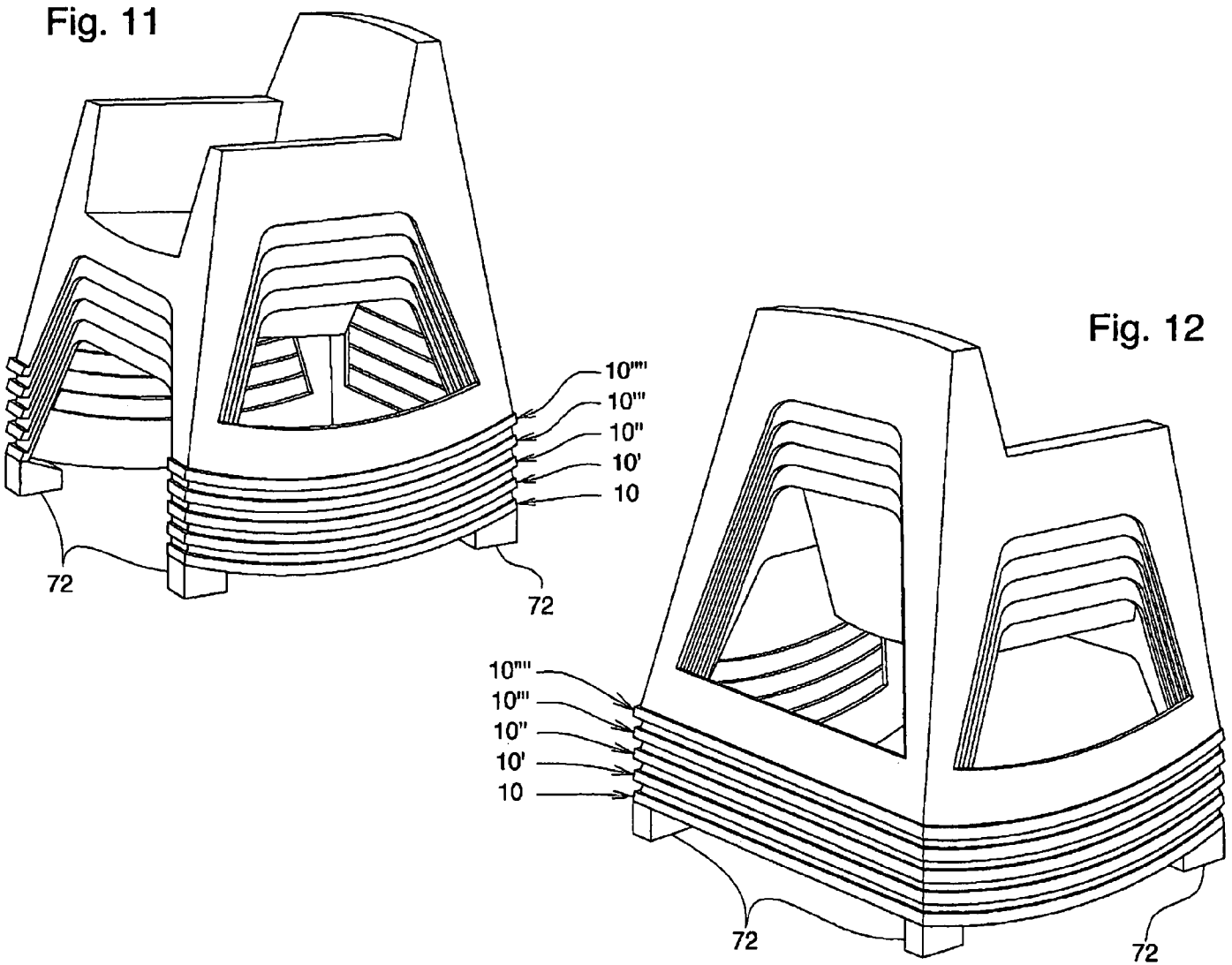
FIGS. 11 and 12 are front and rear perspective views, respectively, of five chairs of FIG. 1 stacked and nested.

Referring to FIGS. 11-12, five identical chairs 10, 10', 10", 10''', and 10'''' are shown vertically stacked and nested. Chairs 10, 10', 10", 10''', and 10'''' nest to an extent that the stack is compact, thus less expensive to ship, store, and display. Optionally, during shipping and/or storage and display, blocks 72 can be used under lowermost edges of chair 10 to prevent stack from rocking. Alternatively, chairs 10, 10', 10", 10''', and 10'''' can be supported on a skid or dolly (not shown) with integral blocks that prevents stack from rocking.

Figure 13:
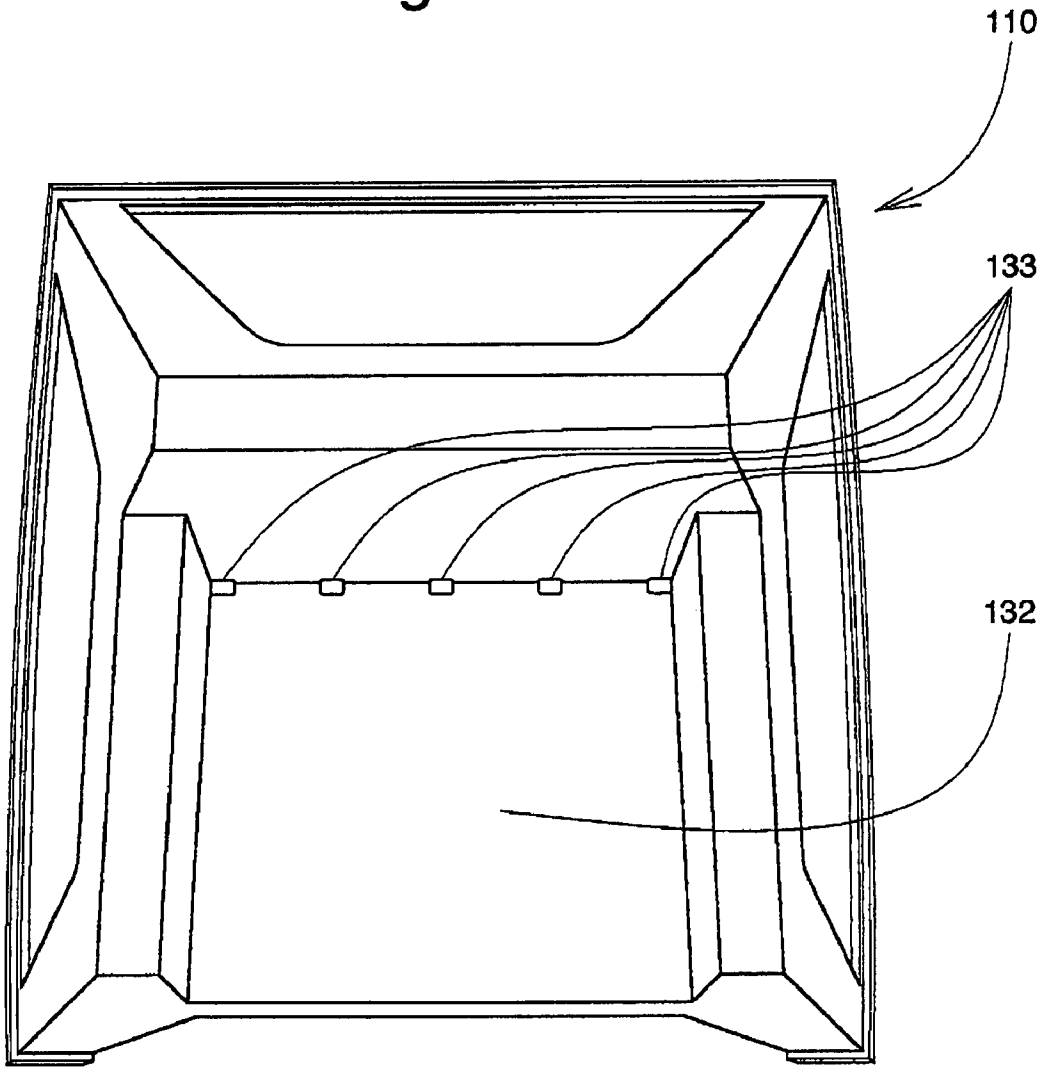
FIG. 13 is a top view of a second example of a rocking chair.

Referring to FIG. 13, second exemplary chair 110 is shown. Chair 110 is similar to chair 10 of FIG. 1. Seat 132 of chair 110 includes a plurality of openings 133. Openings 133 allow water that might collect on seat 132 to drain. This is useful, since chair 110 is commonly used outside where it may be exposed to rain and other moisture.

Figure 15:
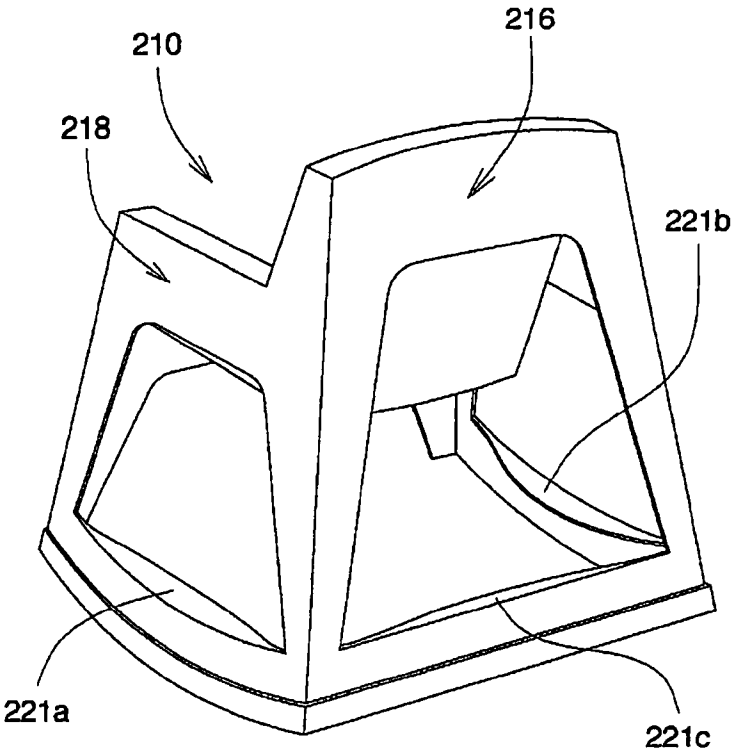
FIG. 15 is a rear, left-side, perspective view of the rocking chair of FIG. 14.
Figure 14:
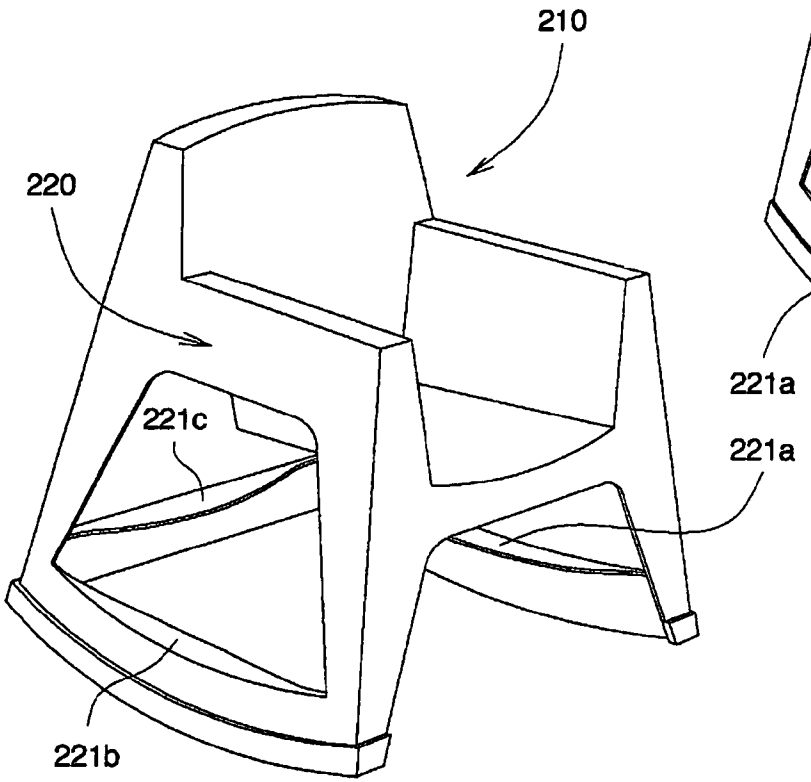
FIG. 14 is a front, right-side, perspective view of a third example of a rocking chair.

Referring to FIGS. 14 and 15, third exemplary chair 210 is shown. Chair 210 is similar to chair 10 of FIG. 1. Sidewalls 218 and 220 and rear wall 216 include inwardly extending flanges 221*a*, 221*b*, and 221*c*, respectively. Flanges 221*a*, 221*b*, and 221*c* increase the structural rigidity of sidewalls 218 and 220 and rear wall 216. Flanges 221*a*, 221*b*, and 221*c* are located and extend inwardly so that they do not interfere with nesting or change the nesting increment N (shown and discussed with respect to FIG. 10).

Figures 16, 17:
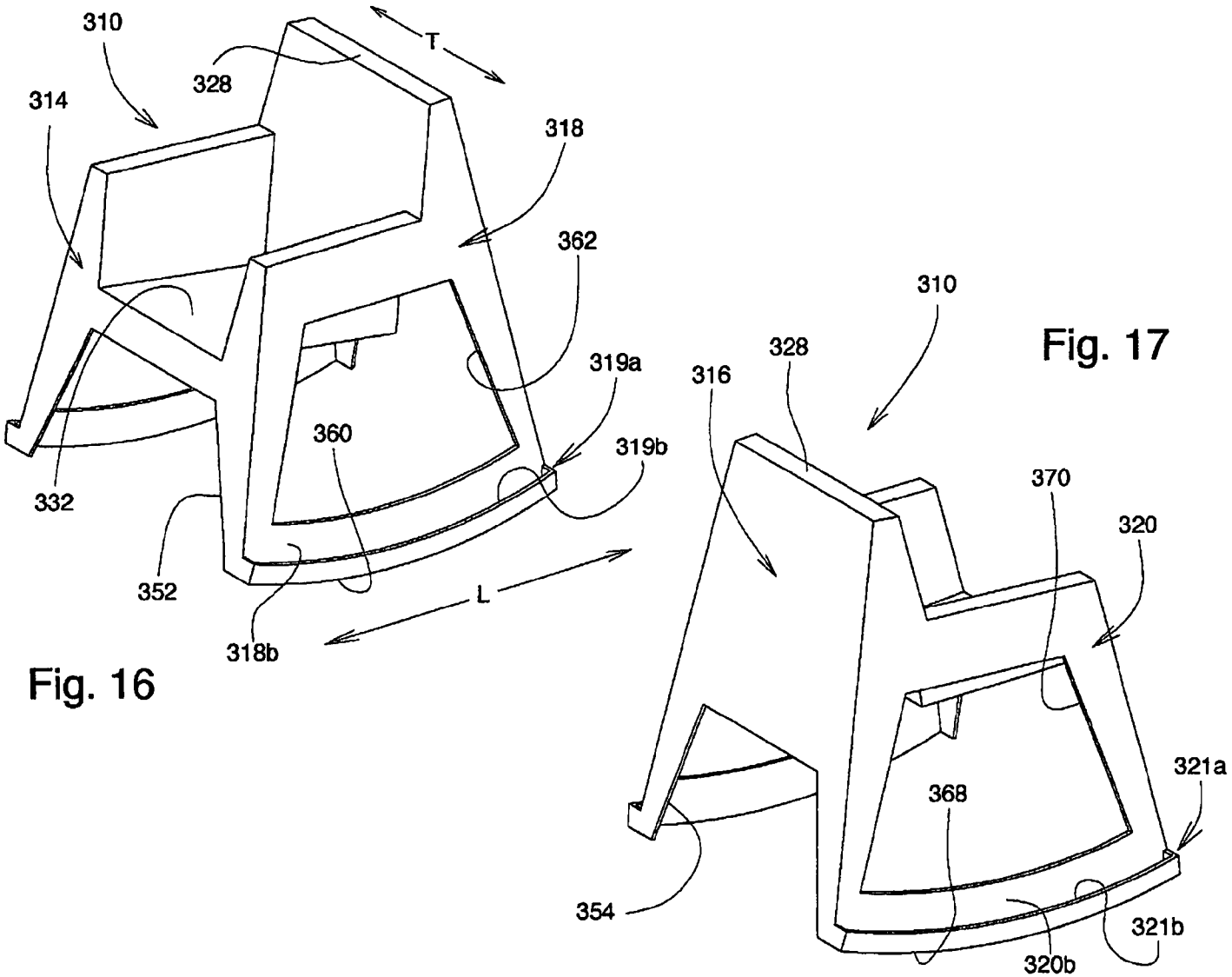
FIG. 16 is a front, left-side, perspective view of a fourth example of a rocking chair.
FIG. 17 is a rear, right-side, perspective view of the rocking chair of FIG. 16.

Referring to FIGS. 16 and 17, fourth exemplary chair 310 is shown. Chair 310 is similar to chair 10 of FIG. 1. Top wall 328 is planar. Front wall 314 lacks enlarged portion 14*d* (see FIG. 1). Rear wall 316 includes cutout 354. First sidewall 318 includes lower rocker extension 319*a* extending outwardly from lower central portion 318*b* to form longitudinally extending groove 319*b* therebetween. Second sidewall 320 includes lower rocker extension 321*a* extending outwardly from lower central portion 320*b* to form longitudinally extending groove 321*b* therebetween. Lower rocker extensions 319*a*, 321*a* add stability to chair 310 at curved lower edges 360, 368 which contact the ground. In addition, shape and size of openings 362 and 370 and cutout 352 are different in chair 310. Furthermore, seat 332 is planar along transverse and longitudinal axes T and L.

Figure 18:
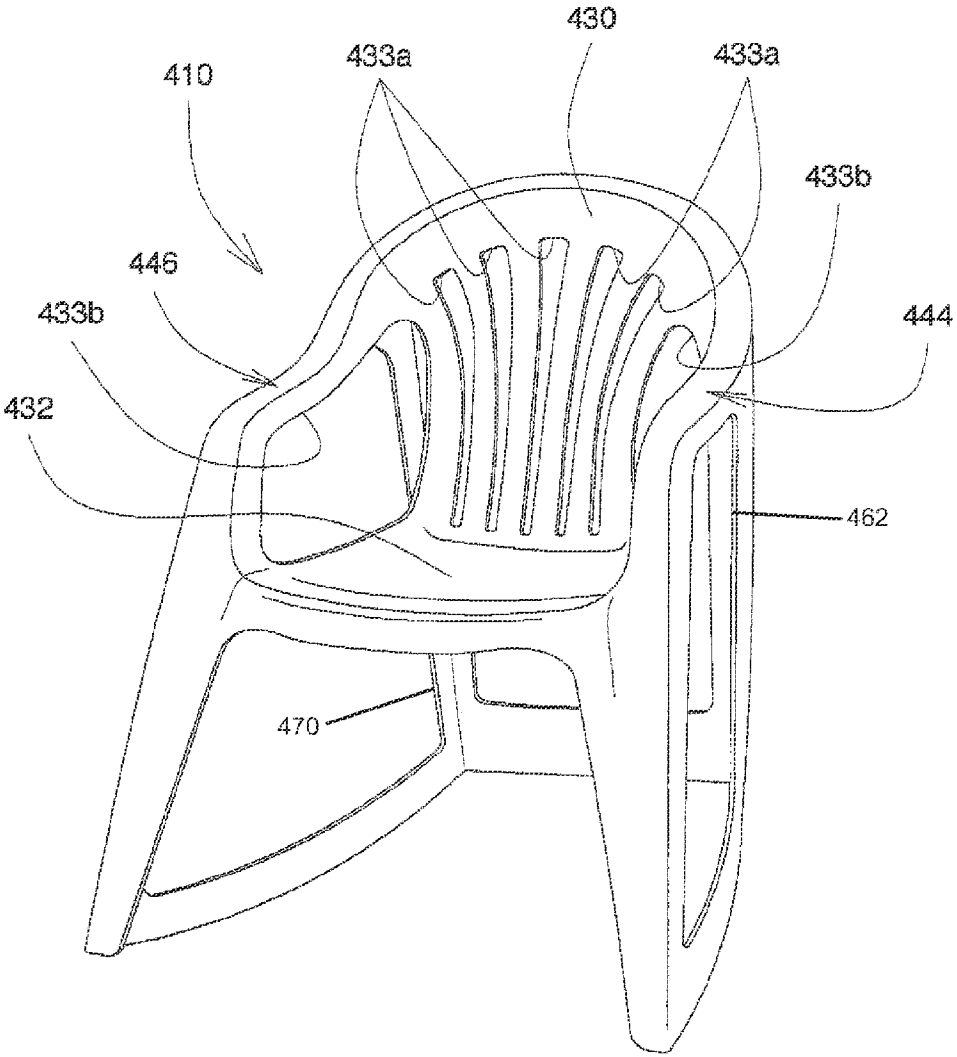
FIG. 18 is a front, perspective view of a fifth example of a rocking chair.

Referring to FIG. 18, fifth exemplary chair 410 is shown. Chair 410 is similar to chair 10 of FIG. i in concept but aesthetically chair 410 has more curved surfaces than chair 10. The curved surfaces of chair 410 change the appearance of chair 410 and reduce surface contact when two identical chairs 410 are nested. Thus, the likelihood of creating a vacuum between such chairs 410 is reduced over stacking chairs 10, 10'. Compound curved surfaces of chair 410 also add significant structural integrity to chair 410. In addition, arms 444 and 446 are rounded at the front, and openings 462 and 470 are shaped differently than cutouts 62 and 70 of chair 10 (See FIGS. 5 and 6). The back 430 of chair 410 may include a plurality of openings 433*a* and side openings 433*b* may also be provided below arms 444, 446. It may be appreciated that the chair 410 will nest with a substantially identical chair, in much the same manner as the first embodiment of FIGS. 1-12. Namely, when nesting two chairs, portions of the inner surfaces of the front and rear legs and the rockers of one chair will slide over portions of the outer surfaces of the front and rear legs and the rockers of the other chair.

Figures 19, 20:
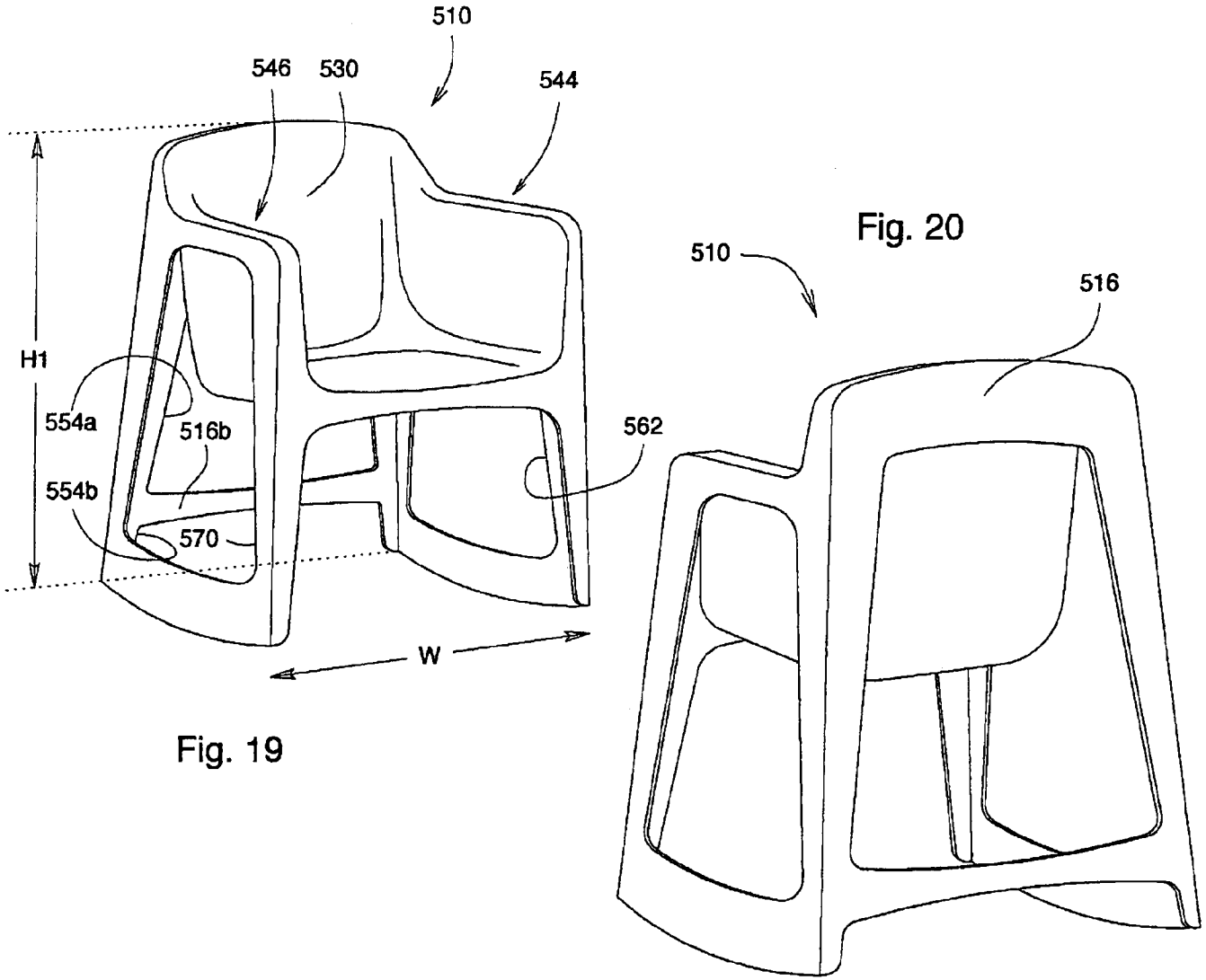
FIG. 19 is a front, right-side, perspective view of a sixth example of a rocking chair.
FIG. 20 is a rear, left-side, perspective view of the rocking chair of FIG. 19.

Referring to FIGS. 19 and 20, sixth exemplary chair 510 is shown. Chair 510 is similar to chair 10 of FIG. 1. Chair 510 has height H1 less than height H of 31 inches of chair 10 (See in FIG. 10) so chair 510 is shorter than chair 10. Chair 510 has a width W greater than largest width W1 of chair 10 (See in FIG. 10) so chair 510 is fatter than chair 10. Chair 510 has backrest 530 that is shorter than backrest 30 of chair 10 (See in FIG. 1) so chair 510 appears squatter than chair 10. As a result, sidewalls 518, 520 and front wall 514 are truncated as compared to sidewalls 18, 20 and front wall 14 of chair 10 (See FIGS. 1-2). Since chair 510 would lack the additional structural strength provided by hollow arms 44 and 46 (See FIG. 1) of chair 10, chair 510 would likely be made of a strong material, such as polycarbonate. Furthermore rear wall 16 includes openings 544*a* and cutout 554*b* to define lower portion 16*b* for bracing the rear of chair 510.

Figures 21, 22:
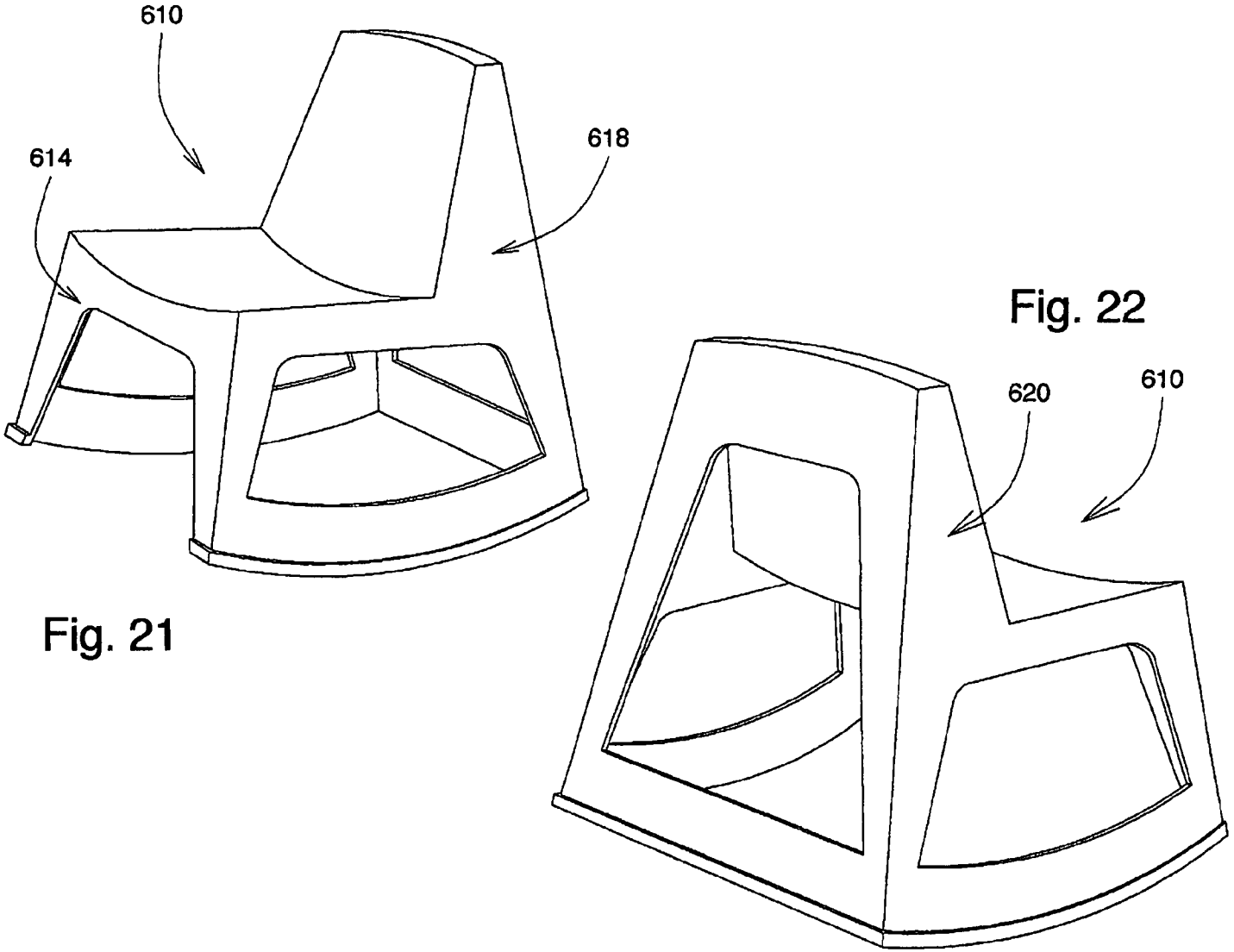
FIG. 21 is a front, left-side, perspective view of a seventh example of a rocking chair.
FIG. 22 is a rear, right-side, perspective view of the rocking chair of FIG. 20

Referring to FIGS. 21 and 22, seventh exemplary chair 610 is shown. Chair 610 is similar to chair 10 of FIG. 1. Chair 610 is armless. As a result, sidewalls 618, 620 and front wall 614 are truncated as compared to sidewalls 18, 20 and front wall 14 of chair 10 (See FIGS. 1-2). Since chair 610 would lack the additional structural strength provided by hollow arms 44 and 46 (See FIG. 1) of chair 10, chair 610 would likely be made of a strong material, such as polycarbonate.

Figure 24:
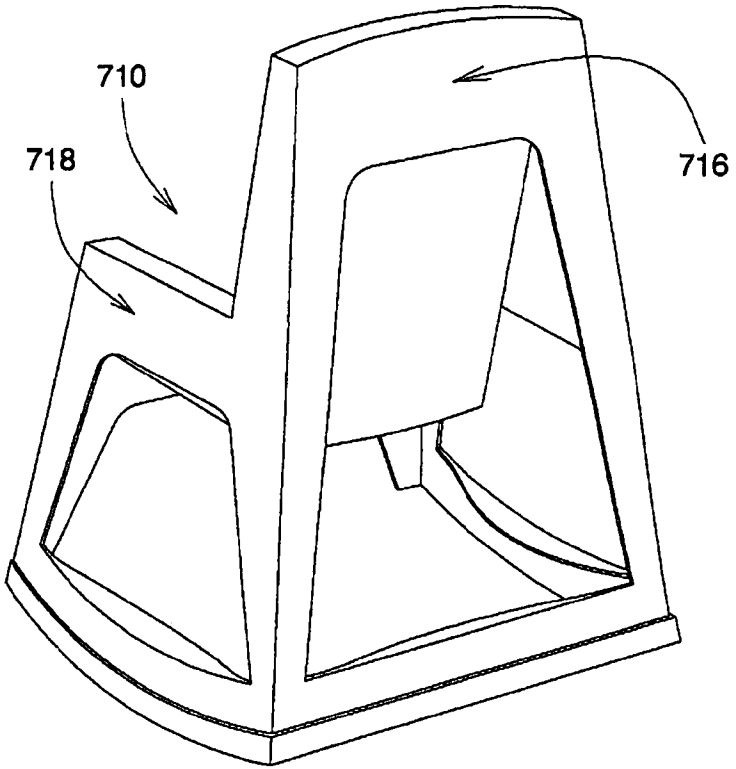
FIGS. 23-24 are front and rear perspective views, respectively of an eighth example of a rocking chair.
Figure 23:
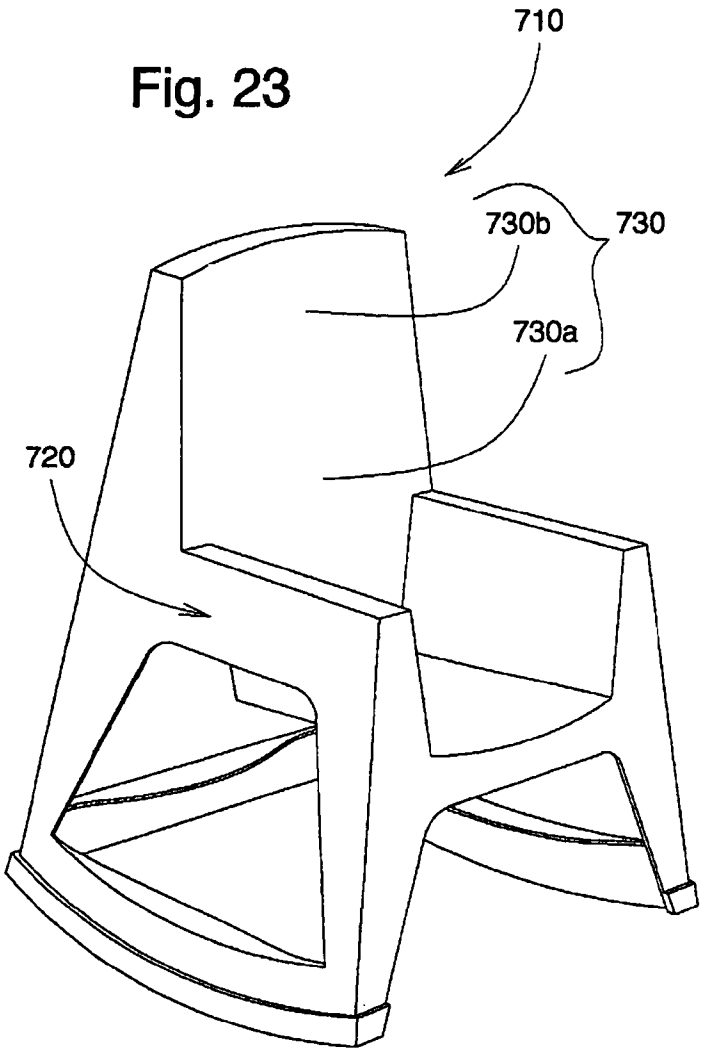

Referring to FIGS. 23 and 24, eighth exemplary chair 710 is shown. Chair 710 is similar to chair 210 of FIGS. 14-15. Chair 710 includes extended backrest 730. Backrest 730 has lower portion 730*a* for supporting a user's back and upper portion 730*b* for supporting a user's head. As a result, sidewalls 718, 720 and rear wall 716 are enlarged as compared to sidewalls 218, 220 and rear wall 216 of chair 210 (See FIGS. 14-15).

Figure 26:
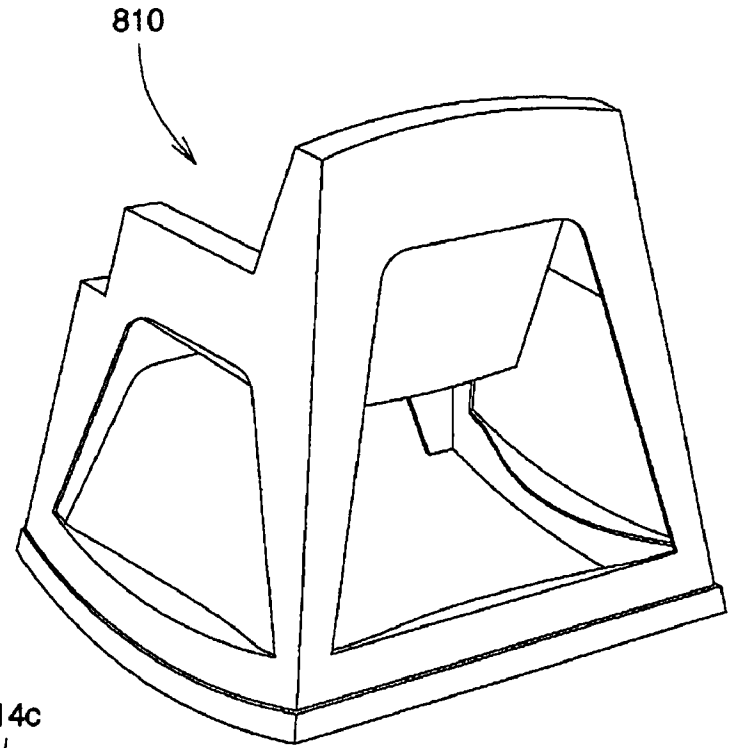
FIGS. 25-26 are front and rear perspective views, respectively of a ninth example of a rocking chair.
Figure 25:
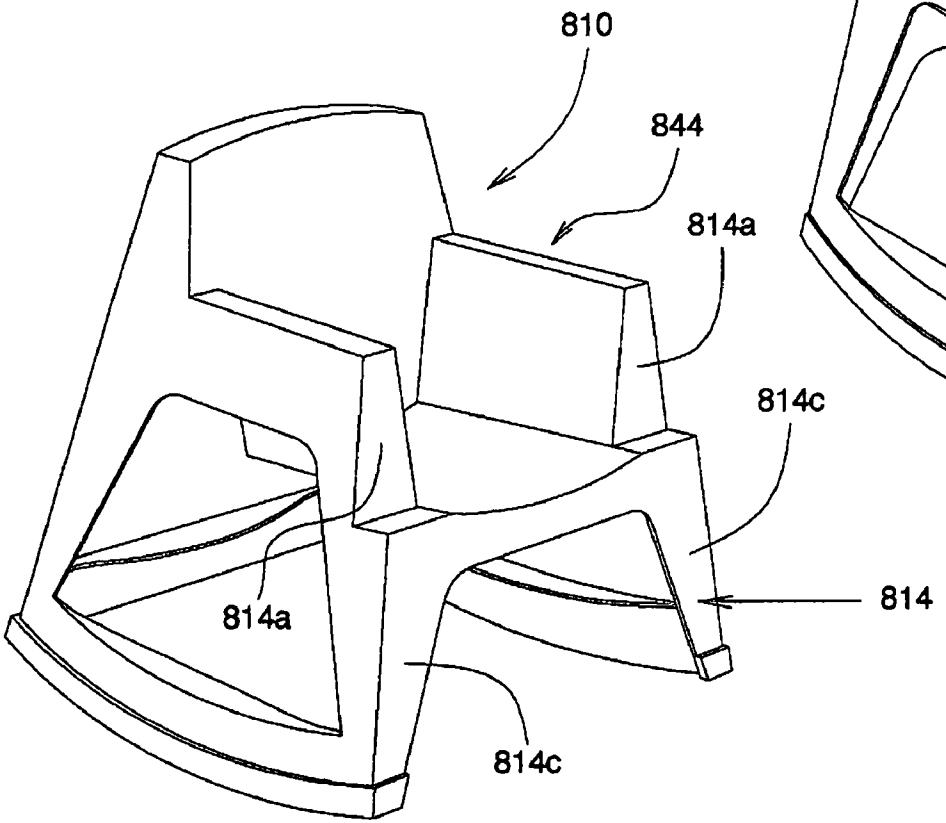

Referring to FIGS. 25 and 26, ninth exemplary chair 810 is shown. Chair 810 is similar to chair 210 of FIGS. 14-15. Chair 810 includes truncated arms 844 and 846 formed by making front wall 814 stepped. Stepped front wall 814 is formed by having lower side portions 814*c* longitudinally offset from upper portions 814*a*. As a result, arms 844 and 846 end spaced from the lower side and center portions 814*c* and 814*b* of front wall 814.

Figure 28:
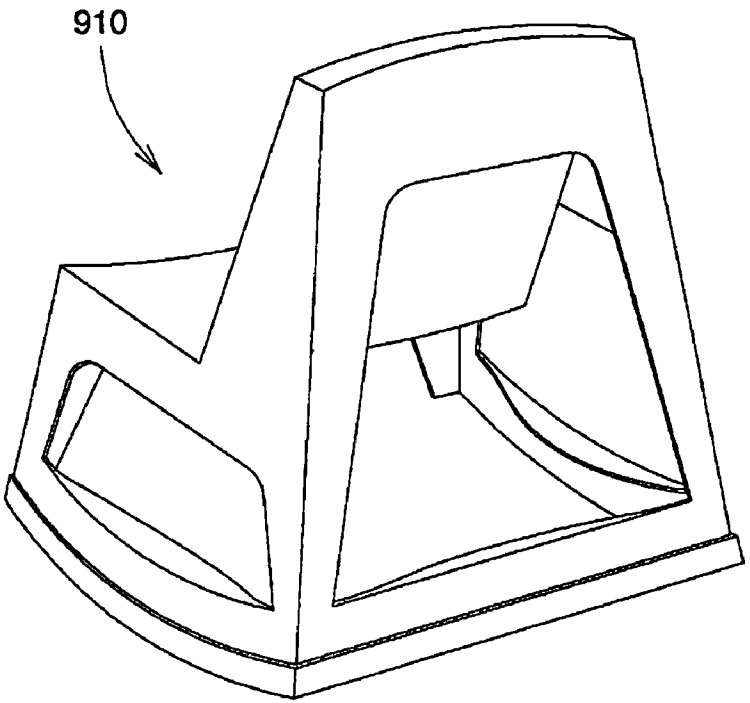
FIGS. 27-28 are front and rear perspective views, respectively of a tenth example of a rocking chair.
Figure 27:
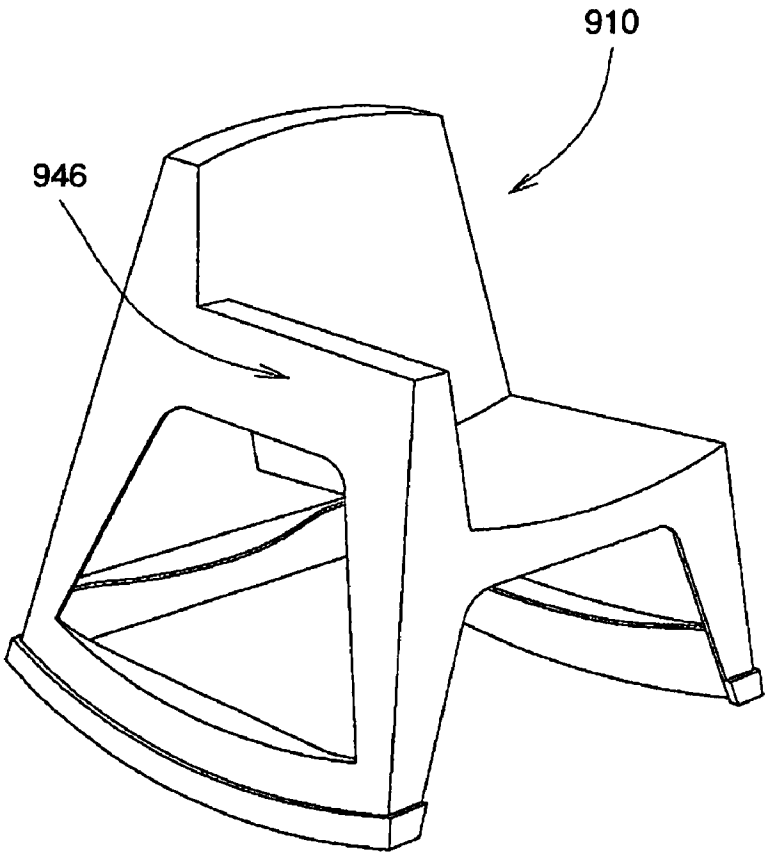

Referring to FIGS. 27 and 28, tenth exemplary chair 910 is shown. Chair 910 is similar to chair 210 of FIGS. 14-15. Chair 910 includes right single arm 946. Alternatively, chair 910 can be formed with a single left arm.

Figure 30:
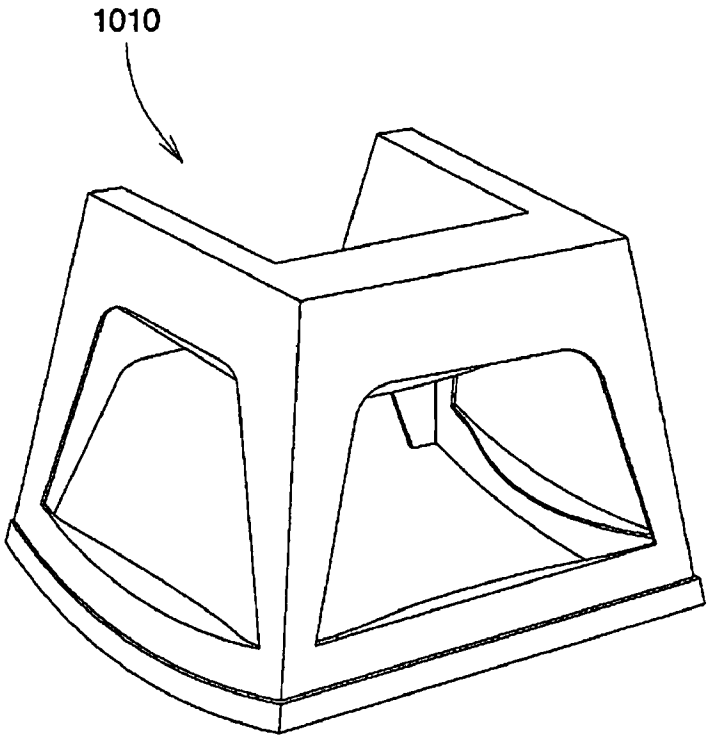
FIGS. 29-30 are front and rear perspective views, respectively of an eleventh example of a rocking chair.
Figure 29:
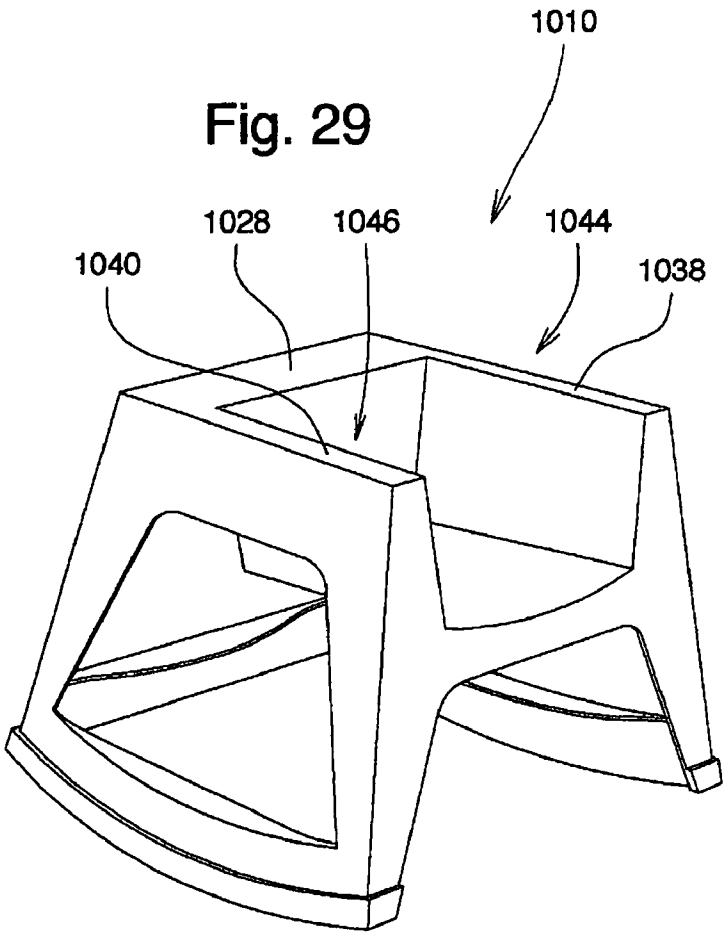

Referring to FIGS. 29 and 30, eleventh exemplary chair 1010 is shown. Chair 1010 is similar to chair 210 of FIGS. 14-15. Chair 1010 includes backrest 1030 and arms 1044, 1046 with surfaces 1028, 1038 and 1040 on the same plane so that backrest 1030 and arms 1044, 1046 are the same height.

Those skilled in the art will appreciate that the conception, upon which this disclosure is based, may readily be utilized as a basis for designing other products. One modification can be the chairs have a different appearance. For example, the angle of the backrest can be modified or the shape and/or size of openings and/or cutouts can be modified. Additionally, the features of one example disclosed above can be used with the features of another example. For example, any chair shown without openings in the backrest and seat may include openings in the backrest and/or seat for drainage or aesthetics. Thus, the details of these components as set forth in the above-described examples, should not limit the scope of the claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. A rocking chair molded in a single monolithic piece, comprising:

a top;

a bottom spaced from said top;

a front wall;

a rear wall spaced from said front wall, said rear wall having a rear upper portion, a rear central portion with side portions, and a rear lower portion;

first and second spaced apart sidewalls joining said front and rear walls, said first and second sidewalls each including an upper sidewall portion, a central sidewall portion with side portions, and a sidewall lower portion that forms a rocker having a curved lower edge;

an intermediate wall extending between said front and rear walls, said intermediate wall forming a backrest and a seat;

said front wall, said rear wall, said first and second sidewalls, and said intermediate wall defining a downwardly opening cavity that includes a first hollow portion above said seat and a second hollow portion below said seat;

said front wall, said rear wall, said first and second sidewalls diverging outwardly from said top to said bottom;

further comprising a strut extending across said lower portion of said rear wall whereby to add structural rigidity to said rocking chair;

said rear wall being substantially planar and having a rear opening formed therein, said rear opening being bounded by said rear upper portion, said side portions of said rear central portions and said strut;

wherein said strut is substantially planar and is coplanar with said rear wall; and said first and second sidewalls each having a sidewall opening formed therein, each of said sidewall openings bounded by the respective sidewall upper portion, said side portions of said sidewall central portion, and said sidewall lower portion.

2. The rocking chair as set forth in claim 1, wherein each of said rockers further include an enlarged lower portion whereby structural rigidity is enhanced as said rockers contact the ground.

3. The rocking chair as set forth in claim 2, wherein said enlarged lower portion extends laterally outwardly from said sidewall lower portion.

4. The rocking chair as set forth in claim 1, wherein each of said rockers further include an additional sidewall that forms a longitudinally extending groove adjacent said sidewall lower portion whereby stability of said rocking chair is enhanced.

5. The rocking chair as set forth in claim 4, wherein said additional sidewall extends laterally outwardly from said sidewall lower portion.

6. A rocking chair molded in a single monolithic piece, comprising:

a top;

a bottom spaced from said top;

a front wall;

a rear wall spaced from said front wall, said rear wall having a rear upper portion, a rear central portion with side portions, and a rear lower portion;

first and second spaced apart substantially planar sidewalls joining said front and rear walls, said first and second substantially planar sidewalls each including an upper sidewall portion, a central sidewall portion with side portions, and a sidewall lower portion that forms a substantially planar rocker having a curved lower edge;

an intermediate wall extending between said front and rear walls, said intermediate wall forming a backrest and a seat;

said front wall, said rear wall, said first and second sidewalls, and said intermediate wall defining a downwardly opening cavity that includes a first hollow portion above said seat and a second hollow portion below said seat;

said front wall, said rear wall, said first and second sidewalls diverging outwardly from said top to said bottom;

further comprising a strut extending across said lower portion of said rear wall whereby to add structural rigidity to said rocking chair;

said rear wall having a rear opening formed therein, said rear opening being bounded by said rear upper portion, said side portions of said rear central portions and said strut; and said first and second sidewalls each having a sidewall opening formed therein, each of said sidewall openings bounded by the respective sidewall upper portion, said side portions of said sidewall central portion, and said sidewall lower portion.

* * * * *

UNITED STATES PATENT AND TRADEMARK OFFICE

CERTIFICATE OF CORRECTION

PATENT NO. : 8,070,229 B2
APPLICATION NO. : 12/233177
DATED : December 6, 2011
INVENTOR(S) : Cooper C. Woodring It is certified that error appears in the above-identified patent and that said Letters Patent is hereby corrected as shown below:

Column 6, Line 13 the portion reading “portion god disposed” should read --portion 20d disposed--.

Column 8, Line 14 in the portion reading “fourth h hollow” should read --fourth hollow--.

Column 8, Line 50 in the portion reading “18 from deforming outwardly” should read --20 from deforming outwardly--.

Column 10, Line 20 in the portion reading “chair 10 of FIG. i” should read --chair 10 of FIG. 1--.

Column 10, Line 52 in the portion reading “rear wall 16” should read --rear wall 516--.

Column 10, Line 53 in the portion reading “includes openings 544a” should read --includes opening 554a--.

Column 10, Line 54 in the portion reading “16b for bracing” should read --516b for bracing--.

Signed and Sealed this
Nineteenth Day of June, 2012

David J. Kappos

David J. Kappos
*Director of the United States Patent and Trademark Office*